US009702208B2

(12) United States Patent
Urquhart

(10) Patent No.: US 9,702,208 B2
(45) Date of Patent: Jul. 11, 2017

(54) REPLACEABLY LINED CABLE GUIDES AND TENSIONING ROLLER FOR DRILL LINE SLIP AND CUT OPERATIONS ON A DRILLING RIG

(71) Applicant: Jesse Urquhart, Edmonton (CA)

(72) Inventor: Jesse Urquhart, Edmonton (CA)

( * ) Notice: Subject to any disclaimer, the term of this patent is extended or adjusted under 35 U.S.C. 154(b) by 460 days.

(21) Appl. No.: 14/192,076

(22) Filed: Feb. 27, 2014

(65) Prior Publication Data

US 2014/0291030 A1 Oct. 2, 2014

Related U.S. Application Data

(60) Provisional application No. 61/770,002, filed on Feb. 27, 2013.

(51) Int. Cl.

| | |
|---|---|
| ***B66D 1/36*** | (2006.01) |
| ***E21B 19/24*** | (2006.01) |
| ***E21B 19/08*** | (2006.01) |
| ***E21B 19/22*** | (2006.01) |

(52) U.S. Cl.

CPC ..... *E21B 19/24* (2013.01); *B66D 1/36* (2013.01); *E21B 19/08* (2013.01); *E21B 19/22* (2013.01)

(58) Field of Classification Search

CPC ..... B66D 1/36; B66D 1/38

See application file for complete search history.

(56) References Cited

U.S. PATENT DOCUMENTS

| | | | | | |
|---|---|---|---|---|---|
| 1,598,802 | A * | 9/1926 | Brown | B66D 1/36 | 254/397 |
| 1,649,184 | A * | 11/1927 | Posey | B66D 1/36 | 184/15.1 |
| 3,150,861 | A * | 9/1964 | Ahlbin | B66D 1/36 | 242/397.2 |
| 3,353,793 | A * | 11/1967 | Nelson | B66D 1/28 | 254/333 |
| 3,367,633 | A * | 2/1968 | Kratzer | B66D 1/28 | 242/157 R |
| 4,057,202 | A * | 11/1977 | Carr, Jr. | B66D 1/36 | 242/157 R |
| 5,669,575 | A * | 9/1997 | Byle | B66D 1/36 | 242/470 |
| 5,678,805 | A * | 10/1997 | Moser | A63B 47/021 | 242/388.8 |
| 6,386,324 | B1 * | 5/2002 | Baranda | B66B 7/06 | 187/251 |
| 7,478,795 | B2 * | 1/2009 | Grapes | B66D 3/02 | 254/333 |
| 7,621,508 | B2 * | 11/2009 | Wagner | F16G 13/07 | 254/372 |
| 7,793,919 | B2 * | 9/2010 | Guyard | B66D 5/18 | 254/345 |
| 8,720,811 | B2 * | 5/2014 | Zink | B65H 75/38 | 242/397 |

(Continued)

*Primary Examiner* — Emmanuel M Marcelo

(74) *Attorney, Agent, or Firm* — Kyle R. Satterthwaite; Ryan W. Dupuis; Ade + Company Inc.

(57) ABSTRACT

Cable guides for overhead support of drill line on a drilling rig during a slip and cut operation feature replaceable liners of wear material supported by a re-usable base. A tensioning roller added to the draw-works resides outward from the periphery of the draw-works drum and is spring-biased toward same into order to force the incoming drill line against the periphery of the drum.

19 Claims, 7 Drawing Sheets

(56) References Cited

U.S. PATENT DOCUMENTS

| | | | | |
|---|---|---|---|---|
| 9,150,392 | B2 * | 10/2015 | Skyba | B66D 1/7452 |
| 2006/0278861 | A1 * | 12/2006 | Leslie | B66D 1/36<br>254/333 |
| 2016/0122163 | A1 * | 5/2016 | Krijnen | E21B 17/1035<br>254/389 |

* cited by examiner

REPLACEABLY LINED CABLE GUIDES AND TENSIONING ROLLER FOR DRILL LINE SLIP AND CUT OPERATIONS ON A DRILLING RIG

CROSS REFERENCE TO RELATED APPLICATIONS

This application claims benefit under 35 U.S.C. 119(e) of U.S. Provisional Application Ser. No. 61/770,002, filed Feb. 27, 2013.

FIELD OF THE INVENTION

The present invention relates generally to drilling rigs used in the oil and gas industry, and more particularly to cable guides and tensioning rollers for use in a slip and cut operation in which a new section of drill line is introduced from a storage reel to replace a length of used drill line being cut from the draw-works.

BACKGROUND OF THE INVENTION

With reference to the prior art shown in FIG. 1, it is known in a slip and cut operation of the type mentioned above to support slack in the drill line at an overhead position elevated above the draw works while feeding a new section of drill line reeled off of the supply reel to replaced used line that is being cut from the draw-works. For this purpose, it is known to use a sling of webbing material attached to an air tugger line as a cable guide through which the slack overhead portion of drill line passes upwardly before turning back downwardly into the mouth of the draw-works. The air tugger line, typically used as a hoist to aid in maneuvering of equipment around the drilling rig, hangs down from its winch that is mounted somewhere on the derrick or mast of the rig so as to suspend the sling at an elevation greater than that of the draw-works. However, this can create concern for rig personnel in the form of safety risks created by the uncertainly of when the closed loop formed by the sling might break open when the webbing material eventually gives way to the abrasion experienced under movement of the metal wire rope of the drill line over and through the sling.

Another safety concern arises in that rig workers sometimes find it necessary to use manual tools to 'hammer' the drill line into grooves provided for same in the draw-works drum, which can place the worker dangerously close to the moving parts of the draw-works.

It is therefore desirable to provide improved solutions for overhead support of the drill line and proper feeding of the new drill line into the draw-works of a drilling rig during slip and cut operations.

SUMMARY OF THE INVENTION

According to a first aspect of the invention there is provided a cable guide for supporting a slack portion of a drill line of an drilling rig at an overhead position elevated above a draw-works of the drilling rig during a feeding of a new section of the drill line from a supply reel during a slip and cut operation in which a used section of the drill line is removed from the draw works, the cable guide comprising a base member defining a pathway along which the slack portion of the drill line is to be routed, and at least one replaceable wear member configured for removable engagement to the base member in a position lining the pathway defined by the base member such that the drill line moves over a wear surface of the wear member in movement along the pathway.

The wear surface of the replaceable wear body may have a greater frictional coefficient greater than a surface of the base member that underlies the wear surface of the wear member.

The base member preferably comprises a body of harder material than the replaceable wear body.

The wear member may comprise a body of polymeric material.

The wear member may comprise nylon.

The base member may comprise a body of metallic material.

The base member may comprise a sheave, a peripheral groove of which defines the pathway, and which may be carried in the overhead position by a tugger line of the drilling rig.

The sheave may be fixed against rotation about a central axis thereof around which the peripheral groove extends. Alternatively, the sheave may be rotatable about a central axis thereof around which the peripheral groove extends, in which case, a brake may be provided to limit a rotational speed of the sheave about the central axis thereof.

The pathway is defined by an upward facing groove curving over an underlying portion of the base member.

The replaceable wear member may comprise a curved liner for receipt in the upward facing groove, the curved liner having a curvature that spans less than 360-degrees.

Alternatively, the wear member may comprise a hollow sleeve sized for passage of the drill line through said sleeve. In such case, the hollow sleeve may be flanged at opposing ends thereof, and the base member may comprise multiple pieces fastentable together from different sides of the hollow sleeve for clamping of the sleeve in place between said multiple pieces.

The base member may be slidably carried for displacement back and forth along a direction transverse to the pathway.

The base member may be movable between a deployed position aligned with the draw works and a stored position withdrawn from alignment with the draw works.

The base member may be carried by a support arm mounted atop a housing of the draw-works.

The support arm may be movably mounted to the housing of the draw-works, may be adjustable in length, and may comprise hinged arm sections pivotal relative to one another to adjust an angle therebetween for adjustment the position of the cable guide by varying said angle.

According to a second aspect of the invention there is provided, in a drilling rig having a draw-works portion of a drill line and a supply reel for storing an unused portion of the drill line for feeding an unused length of said drill line to the draw-works during a slip and cut operation, a cable guide supported at an elevated position above the draw works for supporting a slack portion of the drill line during said slip and cut operation, the cable guide defining a rigid pathway running up and over the cable guide from one side thereof and down from the cable guide on the other side thereof.

The rigid pathway may defined by a peripheral groove of a sheave, which may be assembled from two disc shaped pieces releasably fastened together with a replaceable ring-shaped liner sandwiched between said sheave pieces.

Alternatively, the rigid pathway is defined by a through-bore of a block member, which may be a block assembly comprising a pair of fastened together block pieces with mating sides of the block pieces shaped to define the through-bore between them.

According to a third aspect of the invention, there is provided a draw-works apparatus for a drilling rig, the apparatus comprising a hoisting drum rotatably supported for rotation about a drum axis of said hoisting drum in order to wind a drilling line onto said hoisting drum under rotation thereof in a first direction and to play out said drilling line from said hoisting drum under rotation thereof in a second direction, and a tensioning mechanism comprising a roller supported at a position outward from a periphery of the hoisting drum and biased toward said periphery of the hoisting drum in order to press the drilling line against said periphery of the hoisting drum.

In one embodiment, an axial length of the roller of the tensioning mechanism is at least as great as an axial length of a line-receiving portion of the hoisting drum on which the drilling line is wound.

The tensioning mechanism may comprise at least one support bracket on which the roller is rotatably carried, the at least one support bracket being supported for pivotal motion about a pivot axis parallel to the drum axis and being spring biased toward the periphery of the hoisting drum.

The at least one support bracket may comprise a pair of support brackets disposed at opposing ends of the roller.

BRIEF DESCRIPTION OF THE DRAWINGS

In the accompanying drawings, which illustrate exemplary embodiments of the present invention.

DETAILED DESCRIPTION

Figure 2A:
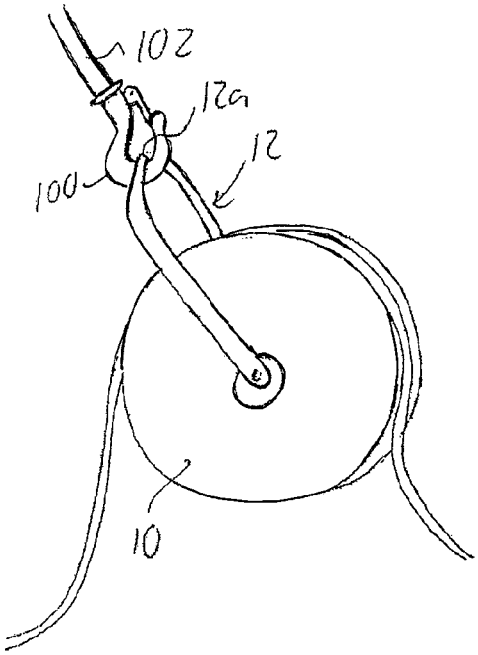
FIG. 2A is a side perspective view of a first embodiment cable guide of the present invention, as being used in place of the sling of FIG. 1 in a slip and cut operation.
Figure 2B:
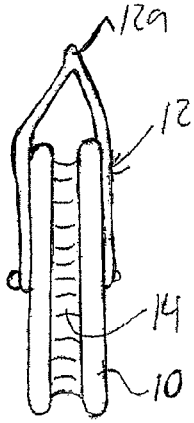
FIG. 2B is an elevational view of the first embodiment cable guide of FIG. 2A from a circumferential viewpoint relative to a stationary sheave thereof.
Figure 1:
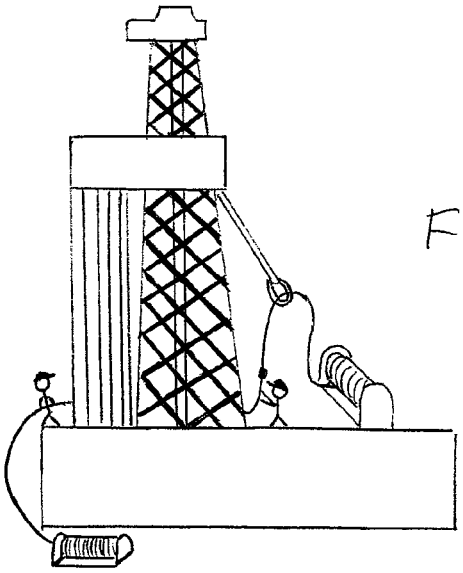
FIG. 1 schematically illustrates a drilling rig during performance of a slip and cut operation to spool a new section of drill line from a storage reel to replace a used length of the drill line that can thus be cut from the draw-works to remove this used length from service, and particularly illustrates prior art use of a fabric webbing sling to support a slack section of the drill line overhead of the draw works during this process.

FIG. 2 shows a first embodiment cable guide that is used directly in place of the prior art sling mentioned above. The cable guide somewhat resembles a conventional pulley in the form of sheave 10 mounted in a support bracket 12. The bracket 12 has a pair of arms at opposite faces of the sheave that extend radially of the sheave and join together at an apex 12*a* located circumferentially outward from the sheave. However, instead of the sheave being rotatable about its central axis, for example as defined by a central shaft joining together the two arms through a central hole in the sheave, the sheave is fixed in place so as to be non-rotatable about its axis. A sheave liner or insert 14 of suitable wear material, for example nylon or another polymeric material, lines the peripheral groove of the sheave, and presents a concave channel that opens circumferentially outward from the sheeve around the full periphery thereof. The nylon or other material of the insert provides a coefficient of friction at the outwardly facing concave surface of the liner that exceeds that provided by the material of the sheave itself at its peripheral groove lying under the liner or insert. The sheave and bracket are made of metal or other material that is of greater strength and hardness than the liner, and provides a rigidly shaped pathway for the drilling line to follow, unlike the prior art use of a flexible sling.

Accordingly, with the drill line of the drilling rig routed over the sheave, which is hung on the coupler 100 at the lower end of the air tugger line 102 by hooking of the coupler 100 through the apex 12*a* of the cable guide's support bracket 12, resistance to the movement of the drill line over the sheave is increased compared to the resistance that would be experienced without use of the liner. The cable guide thus provides a notable degree of frictional grip to the drill line to prevent inadvertent pulling or slipping of the drill line from the cable guide, while its two-piece construction ensures that even if the wearable liner was to wear fully through, the sheave remains intact to still carry the apex of the slack portion of the drill line routed through the bracket lets and over the sheave. Personnel can thus monitor the status of the liner, or schedule routine replacement thereof at intervals known to be less than the effective lifespan of a liner in relation to the usage of the drill line, for example as typically measured in the industry in ton-miles. The liner thus forms a replaceable wear piece of the overall cable guide, and the sheave forms a base for carrying the liner and defining the pathway of the drill line.

Figure 3:
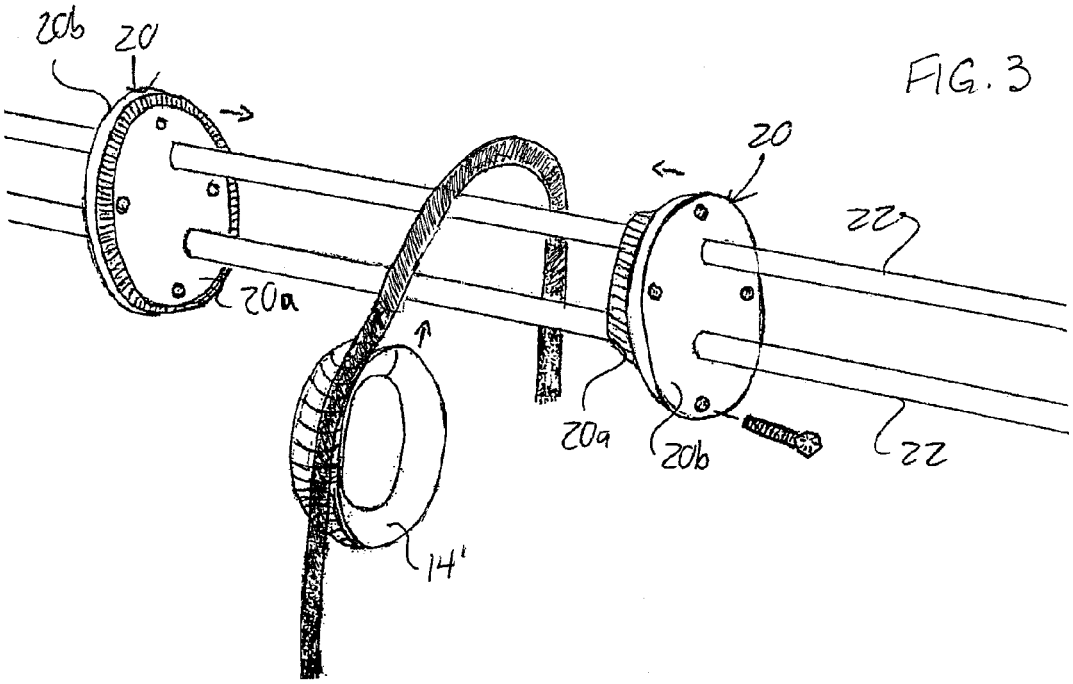
FIG. 3 is an exploded perspective view of a second embodiment cable guide of the present invention.

FIG. 3 shows a second embodiment that again uses a rotationally-fixed sheave-like construction, but forms the sheave from the assembly of two disc-like halves 20 bolted together. At least one of the two discs has an inner portion 20*a* of reduced-diameter circularly-cylindrical form compared to a larger outer portion 20*b* of circular plate-like form forming an outer face of the assembled sheave, whereby the peripheral surface of the cylindrical inner portion(s) 20*a* of the disc(s) forms the peripheral groove of the sheave when the two halves are abutted together at their inner faces, and bolted or otherwise releasably fastened in this assembled condition.

As shown, the disc-shaped halves 20 may be slidably disposed on a rail or track, for example as defined by two or more parallel shafts 22 or rods running in the axial direction of the round discs. A single-piece ring-shaped liner or insert may form the replaceable wear piece 14', in which case the sheave is assembled by removing one of the discs 20 from off the shafts 22, for example at an end of these shafts that is either unsupported for supported in a releasable manner freeing up these ends of the shafts. The ring-shaped liner 14' is slid onto the shafts over the free ends thereof, and the two discs 20 are then slid toward one another from opposing sides of the liner. The inner diameter of the ring-shaped liner fits around the reduced-diameter inner portion of any disc including such a portion, whereafter abutment and fastening together of the discs will secure the liner in place between their larger diameter outer portions, whereby the liner closes around the smaller diameter inner portion(s) of the disc(s) to form the same type of liner described above for the first embodiment.

In another embodiment, the liner may be provided in two pieces, each substantially spanning a respective 180-degrees, and fastened to one another, or to the sheave, from opposite sides of the sheave's circumference. Other embodiments may even employ more than two-pieces to form the liner, each spanning a respective segment of the sheave's circumference. In such multi-piece liner embodiments, the sheave slidable on the shafts 22 may be of a one-piece structure.

Regarding of its makeup, the slidability of the sheave along the shafts provides rig personnel an ability to easily displace the sheave into and out of a useful position in residing in alignment with the draw-works. The shafts 22 run parallel to the rotational axis of the hoisting drum of the draw-works, whereby the sliding direction of the sheave is parallel to the draw-works axis. Accordingly, the sheave can be slid into a deployed position lying axially between the ends of the draw-works hoisting drum when it's time to perform a slip and cut operation, and then after the operation is complete and the cable guide is no longer needed, the sheave can be slid off to an out-of-the-way position situated axially beyond the location of the draw-works. This embodiment avoids the need to use the air tugger line or other external equipment to support the cable guide.

Figure 4:
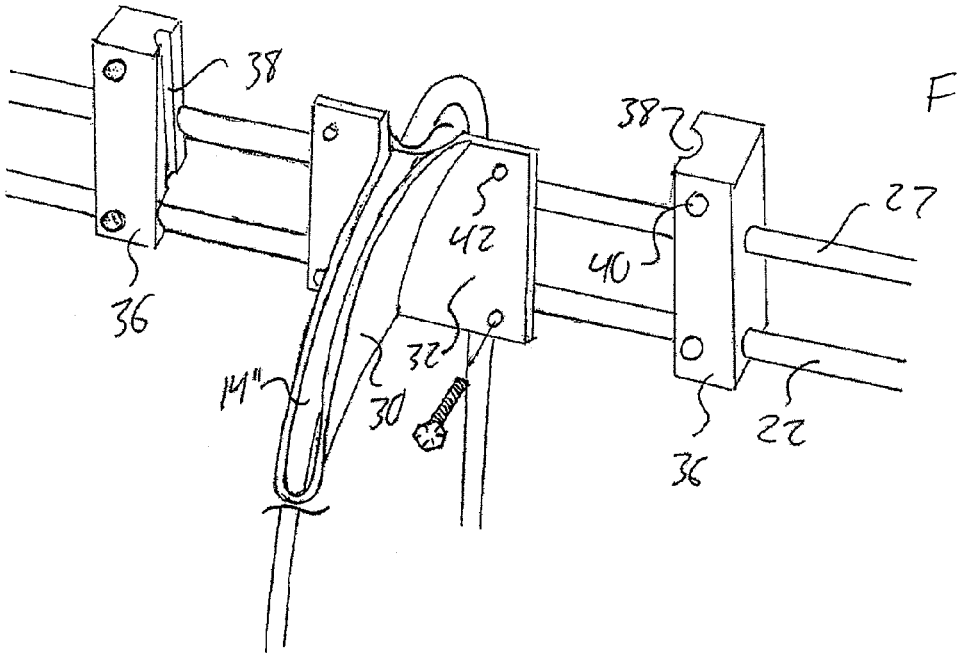
FIG. 4 is an exploded perspective view of a third embodiment cable guide of the present invention

FIG. 4 illustrates a third embodiment in which a somewhat crescent-shaped cable guide member 30 projects outward and downward to one side of a flat mounting plate 32, and features a groove running along its arcuate upper side so that the groove smoothly curves about a horizontal axis parallel to the rotational axis of the draw-works. A replaceable liner 34 of arcuate form is fitted in the arcuate upper groove of the guide member 30 to run from the lower tip thereof to a position overlying the mounting plate, thereby following a pathway over the guide member 30 for the drill line to extend upwardly thereover and down the other side.

Two mounting blocks 36 are slidably disposed on parallel shafts 22 of the same configuration as the second embodiment, and feature semi-cylindrical channels 38 of vertically upright orientation at their inner sides that face toward one another along the shafts 22, whereby under flush abutment of the remainder of the two blocks' inner faces against one another, the two semi-cylindrical channels 38 form a cylindrical through-bore running vertically downward through the abutted blocks. The radius of the two identical channels slightly exceeds that of the drilling line, whereby the drilling line can pass downward through the through-bore of the mating blocks after having passed upwardly over the cable guide 30.

Fastener holes 40 in each block 36 at the side thereof facing away from the shafts 22 to the side thereof on which the mounting plate 32 is disposed match up with fastener holes 42 in the mounting plate 32 on a respective side of the cable guide member 30 when the two blocks 36 are abutted together. Under sliding of the two blocks together along the shafts 22, the mounting plate 32 can be bolted to the blocks, thereby assembling these three pieces together to secure the cable guide 30 to the shafts 22 for sliding therealong as described for the preceding embodiment. The third embodiment demonstrates that non-rotational cable guide embodiments may have non-circular forms differing from the first two sheave-like embodiments, while still providing a smoothly curving arcuate travel path for passage of the slack portion of the drilling line over the cable guide.

FIG. 5 illustrates a fourth embodiment cable guide again employing track-defining parallel shafts 22 running parallel to the rotational hoist axis of the draw-works 200, and two blocks 36' with semi-cylindrical channels 38' recessed into their inner sides to form a vertical through-bore when slid against one another on the shafts 22. Unlike the third embodiment however, the blocks 36' bolt directly to one another through fastener holes 40' that lie parallel to the axes of the shafts 22, and no separate guide member is provided. Instead, the vertical channel through the fastened-together blocks 36 defines the liner-equipped pathway for passage of the drilling line to the draw works 200 below.

Figure 5A:
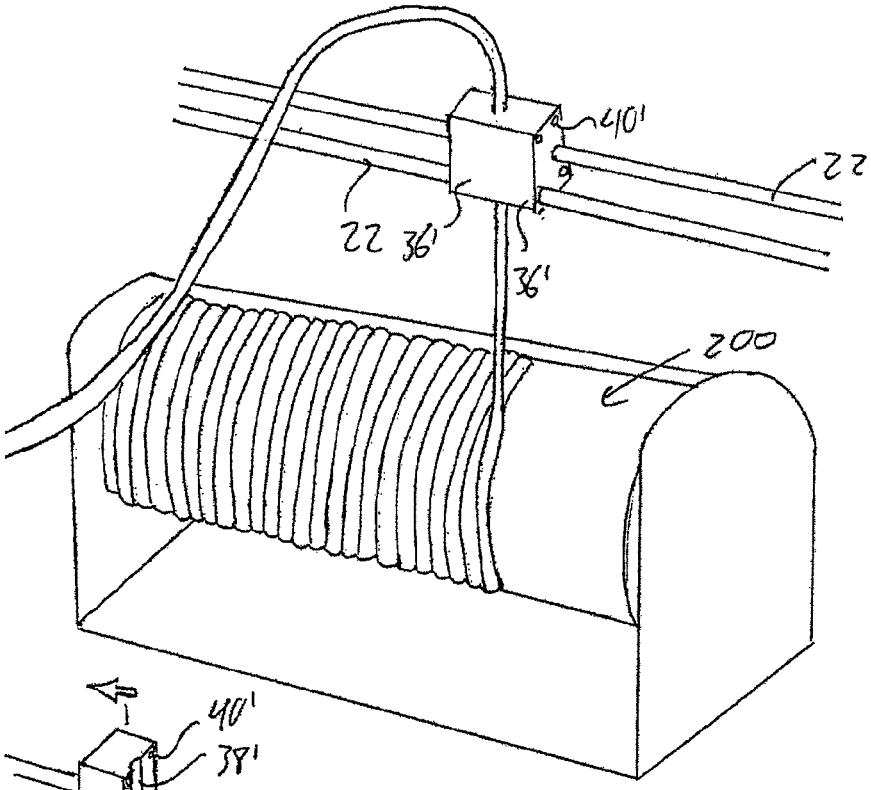
FIG. 5A is a perspective view of a fourth embodiment cable guide of the present invention, as being used in a slip and cut operation.
Figure 5B:
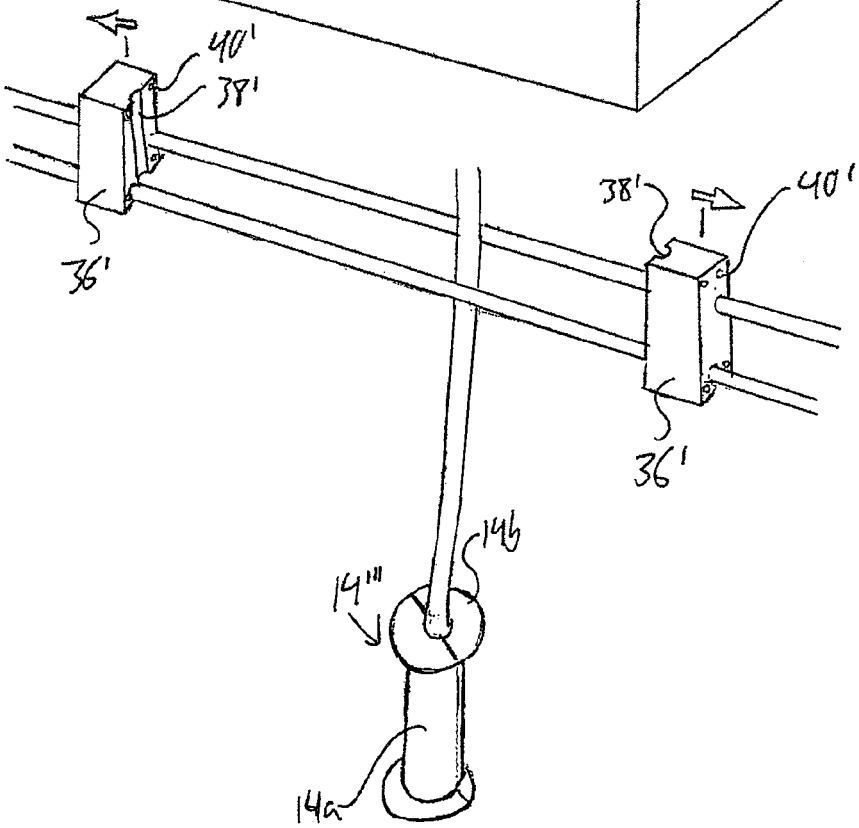
FIG. 5B is an exploded view of the fourth embodiment cable guide of FIG. 5A.

As shown in FIG. 5B, an assembled liner 14''' of this embodiment has a sleeve-like form featuring a hollow cylindrical portion 14*a* having flanges 14*b* that span radially outward at both ends thereof. The through-bore of the assembled blocks 36' slightly exceeds the outer diameter of the cylindrical center portion 14*a* of the sleeve, but is less than the outer diameter of the flanged ends 14*b* of the sleeve. The liner 14''' is formed in two halves, each for generally flush placement within the semi-cylindrical recess of a respective one of the blocks 36 so as to open toward the opposing block, whereby sliding of the blocks and liner halves together along the shafts 22 from opposite sides of the drilling line will operate to place the drilling line inside the resulting sleeve, which is then held closed by the fastening of the two blocks together. The flanges prevent the cylindrical center portion of the sleeve from being axially displaced from the bore of the assembled blocks.

As shown in FIG. 5A, the shafts 22 are suitably positioned so that the bore of the fastened together blocks, and thus the sleeve disposed therein, generally align with a tangent of the hoist drum of the draw-works 200 so that the slack drilling line feeds nicely onto same from the cutting guide during the slip and cut operation. As shown in FIG. 5B, the shafts 22 may pass through each block on respective opposite sides of the semi-cylindrical channels 38 therein, with the drilling line thus passing between the two shafts 22.

Figure 6:
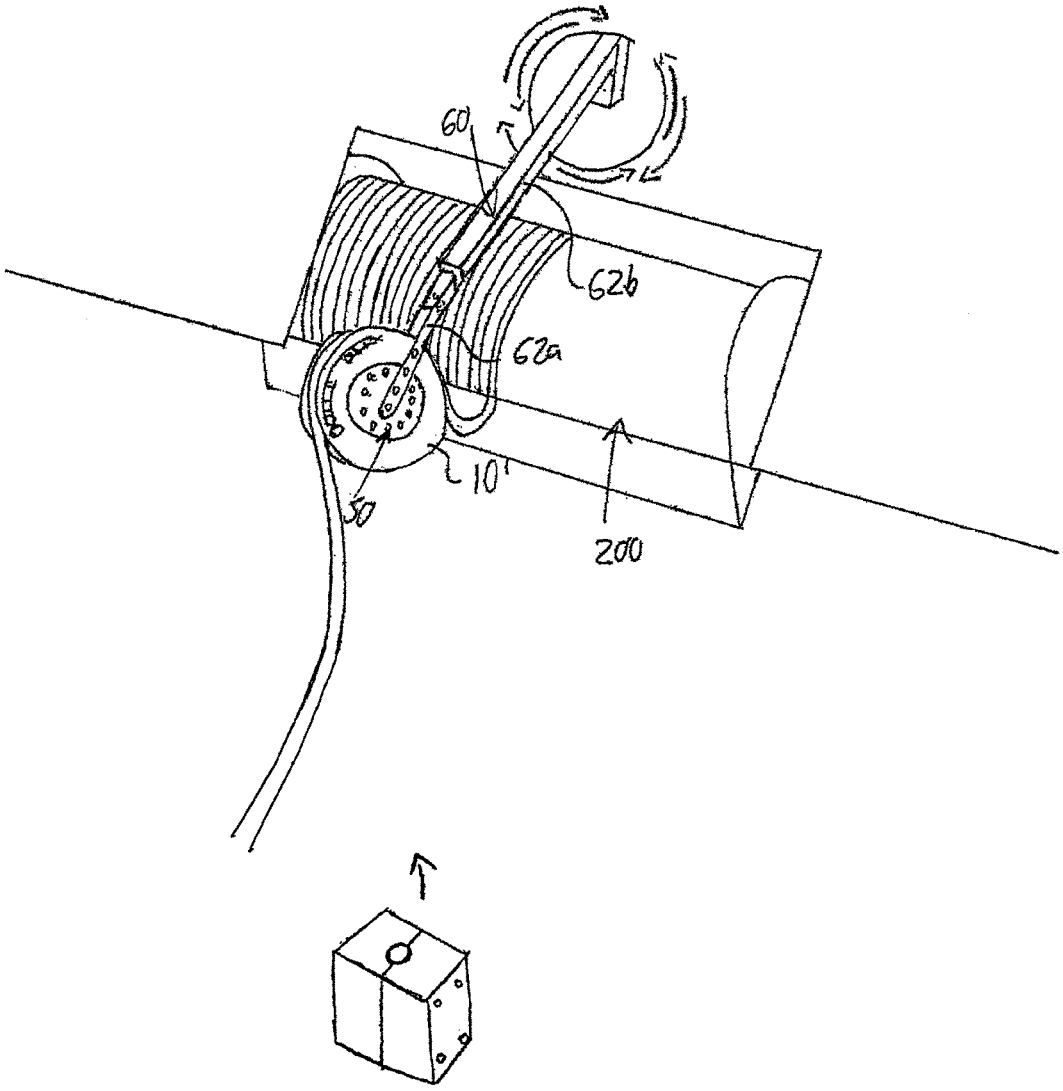
FIG. 6 is a schematic perspective view of a fifth embodiment cable guide of the present invention, as being used in a slip and cut operation.

FIG. 6 shows a fifth embodiment employing a sheave 10', but in a pulley configuration in which the sheave 10' is rotatably supported for rotation about its central axis. While still employing a wear liner like that of the first embodiment, this embodiment thus allows rotation of the sheave. Like all the above embodiments, the cable carrier thus employs a permanent, or intendedly permanent, base to which a replaceable wear member is engaged to provide the advantages frictional action of the wear material, such as nylon, with the reliability of the stronger base material, such as steel or other metal. However, to prevent slippage or inadvertent rapid movement of the drilling line, a brake system 50, for example a disc brake or hydraulic brake is provided in order to limit the rotational speed attainable by the sheave, although at the cost of added complexity compared to rotationally-fixed embodiments.

FIG. 6 also illustrates an alternate configuration for supporting the cable guide. Instead of having the guide slidably supported on shafts, a main support arm 60 is mounted atop a housing of the draw-works 200 to reach forwardly therefrom at a height elevated above the hoist drum thereof. As shown, the support arm 60 may be of telescopic construction, allowing a length by which a distal arm section 62*a* can be slid into and out of a proximal arm section 62*b* coupled to the draw-works housing. In addition, the proximal arm section 62*a* may be swivel-mounted to the roof or topside of the draw-works housing for pivoting about an upright axis. Accordingly, a lateral position of the cable guide back and forth along the draw-works axis can be adjusted through swiveling of the support arm, and a fore-aft position of the cable guide can also be adjusted in a direction transverse to the draw-works axis by telescopic extension and collapse of the support arm's length. The distal arm section 62*a* may feature a hinge joint 64 to allow further adjustability of the cable guide, for example in the lateral direction along the draw-works axis.

It will be appreciated that benefits of the support arm arrangement described for the rotatable sheave embodiment of FIG. 6, for example for one or both of horizontal and vertical adjustment of the cable guide position, may also be employed with the other styles of cable guide described herein, including stationary (i.e. rotatably fixed) sheave bases with ring-type liners and block-type bases with sleeve-type liners. Although use of a wearable insert or liner is preferred, other embodiments may lack such a feature, and instead use a fixed or rotatable sheave or bored block configuration alone to guide the drilling line in its approach to the draw works during a slip and cut operation.

Figure 7A:
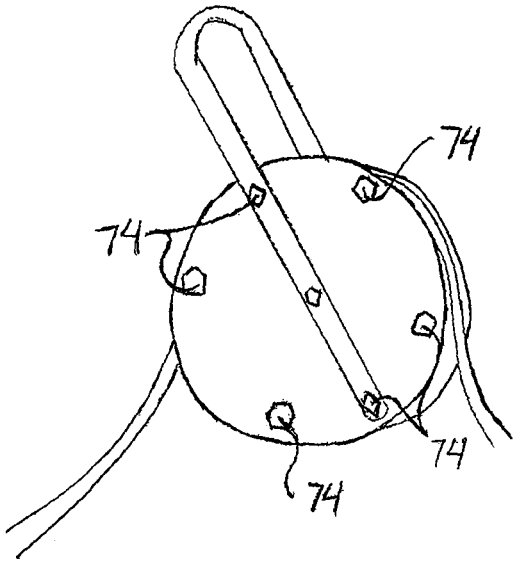
FIG. 7A is a schematic side perspective view of a sixth embodiment cable guide of the present invention, having some similarity to the first embodiment.
Figure 7B:
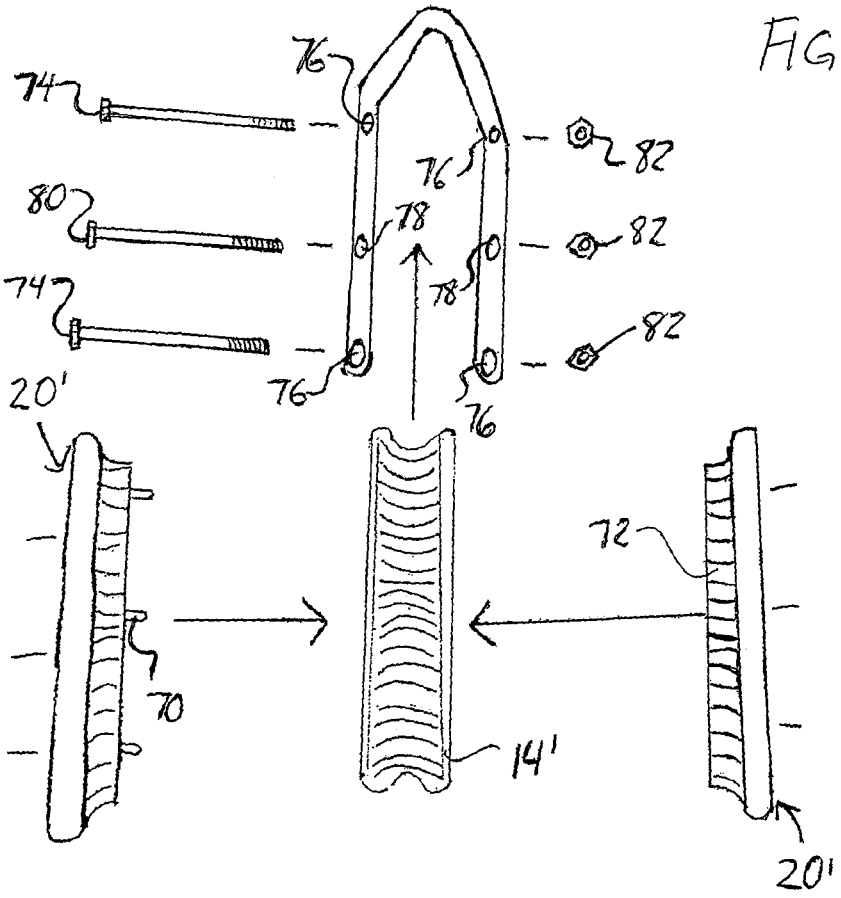
FIG. 7B is a schematic exploded view of the sixth embodiment cable guide of FIG. 7A.

FIG. 7 shows a sixth embodiment that is functionality equivalent to the first embodiment of FIG. 2. However, while the first embodiment employs a single-piece sheave of unitary body construction on which a multiple piece liner or insert is installed (as described above as an alternative for the shaft-mounted embodiment of FIG. 3), the sixth embodiment employs a two-piece sheave construction and single-piece liner construction like that described above for the shaft-mounted embodiment of FIG. 3. Dowel-like pins 70 project from the inner face of one of the discs 20' for receipt in corresponding pin/dowel holes in the inner face of the other disc in order to positively align the two discs with one another when abutted face-to-face inside the one-piece ring-shaped liner 14' in a manner placing the pins in the pin holes. Axially oriented grooves 72 are recessed in the periphery of the reduced diameter portion of each disc to accept fins that projecting a short distance radially inward on an inside of the ring-shaped liner to lock the liner against rotation on the sheave assembled from the two discs.

The discs 20' feature axially-oriented holes passing through them at circumferentially-spaced locations around the discs at a radial distance inward from the periphery of the reduced diameter inner portions of the discs, and the two discs are fastened together through these holes by bolts 74. A bracket 12' similar to that of the first embodiment has two arms, each spanning diametrically across the outer face of a respective one of the discs 20', and two of the bolts 74 pass through these arms at diametrically opposite holes in each of the discs at corresponding holes 76 in each bracket arm. As shown, each bracket arm may also include a third hole 78 for alignment with a hole at the central axis of each disc 20' for use of a third bolt 80 in fastening of the bracket and discs together at the center of the resulting sheave by engagement of the three bracket-holding bolts into nuts 82 at the other side of the bracket.

Figure 8A:
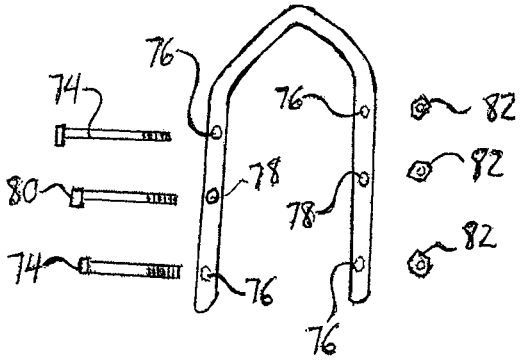
FIG. 8A is a schematic exploded view of a variant of the sixth embodiment cable guide of FIG. 7.
Figure 8B:
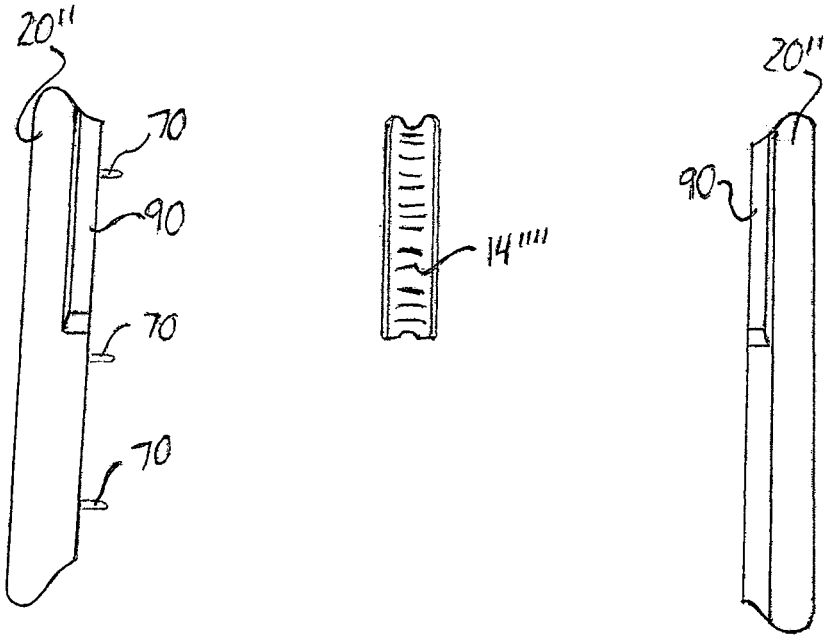
FIG. 8B is a side view of a liner or insert of the cable guide of FIG. 8A.
Figure 8B:
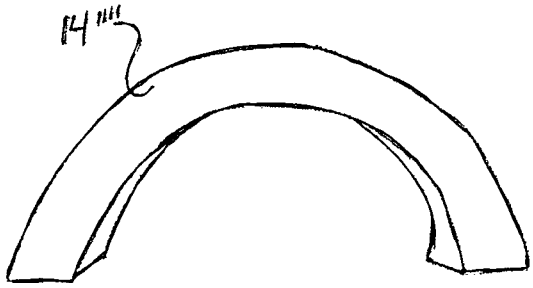

FIG. 8 shows a variation of the embodiment shown in FIG. 7. In this variant the discs 20" that assemble together to form a sheave-shaped base for supporting the replaceable wear liner differ from the discs 20' of FIG. 7 in that the inner portions of the discs that face one another are each configured with an area 90 of reduced radius that spans approximately half of the disc's circumference, whereby the assembly of the two discs face-to-face at their inner portions creates an approximately 180-degree acruate groove spanning circumferentially of the assembled base over the topside thereof. Accordingly, the wear liner 14"" is not a fully annular or ring-shaped liner like that of FIG. 7, but rather is an arc-shaped liner of approximately 180-degree span that resides in the matching topside groove of the base defined by the assembled discs 20". The liner 14"" is clamped in place between the two discs 20" of the base in a position curving arcuately over the top of the base. This reduces the size of the liner compared to the ring-shaped liner 14' of FIG. 7, and thus potentially reduces the manufacturing cost of the liner, while still providing the required wear material where the drill line will pass over the topside of the base. While the two-piece base shown in FIG. 8A uses circular disc-shaped pieces, it will be appreciated that other shapes may be employed while still providing a curved groove over the topside of the base to define the lined path for the drill line to pass over the base and down toward the draw-works.

Figure 9:
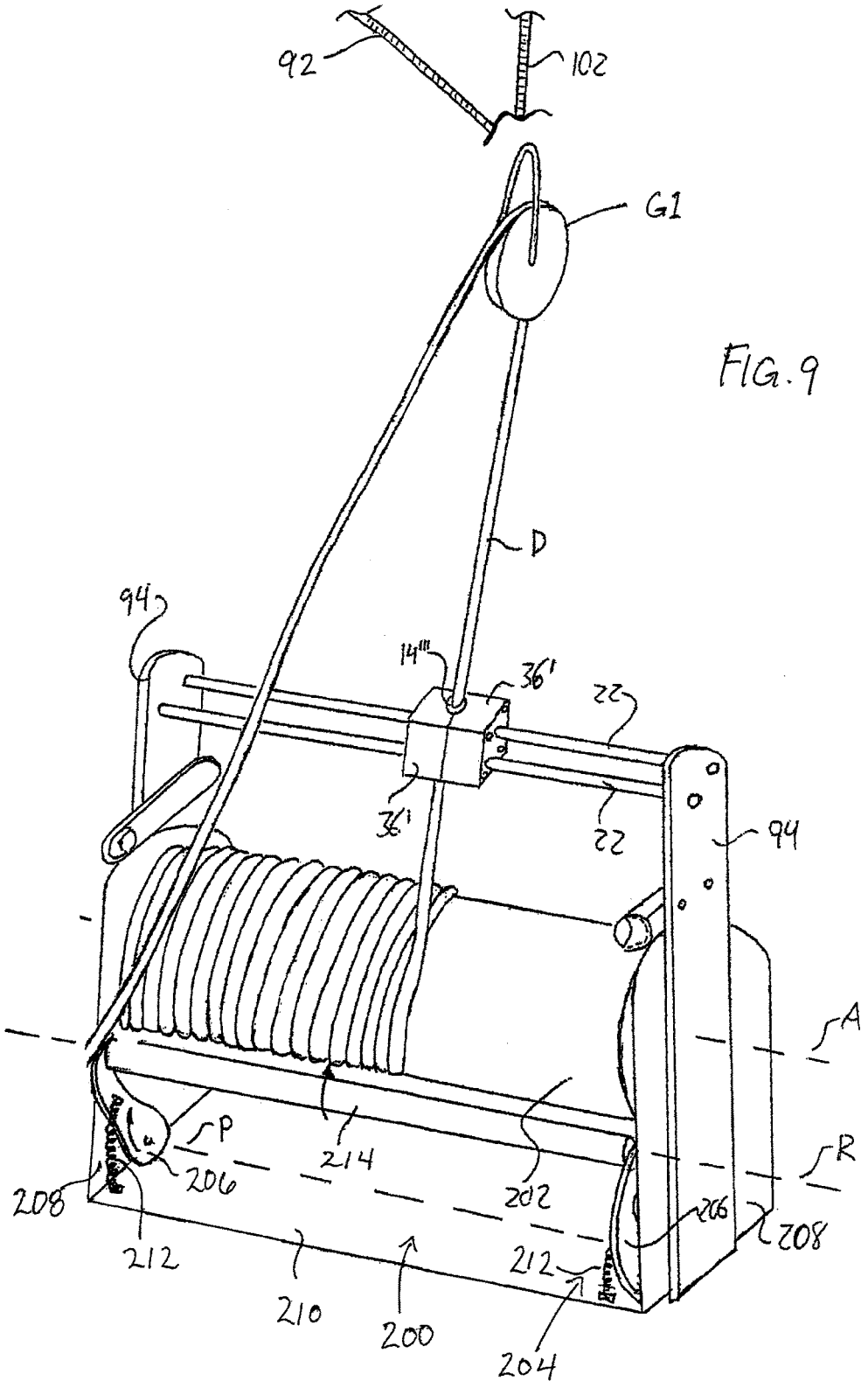
FIG. 9 is a schematic perspective view of combined use of two different cable guides together during a slip and cut operation being performed on a draw-works that also features a tensioning roller of the present invention.

FIG. 9 illustrates use of two cable guides on the same drill line D as it is fed onto the hoist drum 202 of a draw-works. A rotatable or non-rotatable sheave-like cable guide G1 (for example of the type disclosed in FIG. 2 or 7) is hung on air tugger line 102 or other rope/line/cable 92 attached to the drilling derrick, and a block and sleeve style cable guide G2 of the type disclosed in FIG. 5 is slidably supported on parallel shafts 22 that are supported parallel to the drum axis A of the hoist drum 202 at a height thereabove by upright supports 94 that are disposed respectively beyond the two ends of the drum 202. The sheave-style cable guide situated at an elevation above that of the sleeve and block style cable guide provides a smooth transition of the drill line down to the sleeve and block style cable guide below it. A conventional pulley or sheave with no replaceable liner may be used in place of a liner-equipped sheave-style cable guide of the present invention to serve as the first guide that directs the drill line down into the block and sleeve style cable guide G2.

The draw-works 200 of FIG. 9 is further modified from a conventional arrangement by the addition of a line tensioning assembly 204. The assembly 204 features a pair of support brackets 206 that are pivotally mounted to a frame 208 of the draw-works to allow pivoting of the two brackets 206 about a pivot axis P that is parallel to the longitudinal rotation axis A of the hoist drum 202. In the illustrated embodiment, the brackets 206 are pivotally coupled to upright walls 208 of the draw-works 200 on which the hoist drum 202 is also rotatably carried, but the bracket may alternatively be pivotally carried on a floor panel 210 of the draw-works frame or another suitable support situated proximate the hoist drum 202. A compression spring 212 for each bracket 206 has one end attached to the bracket at a radial distance from the pivot axis P and the other end attached to the floor panel 210 or another fixed point elsewhere on the draw-works frame, for example on the respective one of the upright walls 208 thereof, so that the spring 212 acts to pivot the brackets 206 in a predetermined direction about the pivot axis P that opposes the rotational direction of the drum 202 during winding of the new drill line D onto the drum.

A cylindrical roller 214 has its opposing ends rotatably supported by the brackets 206 at distal ends thereof that are located opposite the pivotally mounted ends of the brackets 206. The roller 214 is rotatable relative to the brackets about a rotational axis R lying centrally longitudinal of the roller 214 and parallel to the drum axis A and the pivot axis P. The springs 212 bias the brackets 206 in a direction moving their distal ends toward the hoist drum 202 in order to bias the roller 214 toward the drum's periphery, as shown schematically with solid-headed arrows in FIG. 9. The brackets and their shared pivot axis are situated to the side of the drum from which the drill line wraps onto the drum so that the roller is biased toward the lower quadrant of the drum's periphery on this side. This spring biased roller thus presses the incoming feed of the drill line against the periphery of the drum at this front lower quadrant of the drum in order to help achieve a tensioned winding of the drill line tightly against the periphery of the drum. In the case of a grooved hoist drum periphery where grooves in the drum define a pre-defined layout path for winding of the drill line onto the drum, the spring-biased tensioning roller 214 helps force the drill line into the grooves of the drum, thereby avoiding the need for manual assistance to this process by rig workers, thus increasing worker safety by keeping the workers away from the moving parts of the draw-works.

The axial length of the single roller 214 in the illustrated embodiment spans the full axial length of the area of the drum 202 that is arranged to accommodate winding of the drill line thereon, whereby the roller 214 will always be in contact with the portion of the drill line being currently wound onto the drum. In other embodiments, more than one roller may be employed, each being carried by a respective pair of brackets and each spanning a respective portion of the axial length of the drum's winding or line-receiving area. Adjacent rollers in such a multi-roller configuration may be slightly offset from one another around the circumference of the drum so that the axial lengths of the rollers overlap one another to ensure that the rollers collectively cover the full axial length of the entire winding area of the drum.

Each roller 214 may be supported by two separate and distinct spring-loaded support brackets, as shown in the illustrated, or alternatively may be supported by a single spring-loaded support, for example a single bracket having a single spring-loaded pivotal connection to the draw-works at a position located generally centrally of the roller's length, and featuring a bifurcated arrangement that splits into two support arms each carrying a respective end of the roller.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A cable guide for supporting a slack portion of a drill line of a drilling rig at an overhead position elevated above a draw-works of the drilling rig during a feeding of a new section of the drill line from a supply reel during a slip and cut operation in which a used section of the drill line is removed from the draw works, the cable guide comprising a base member defining a pathway along which the slack portion of the drill line is to be routed, and at least one replaceable wear member configured for removable engagement to the base member in a position lining the pathway defined by the base member such that the drill line moves over a wear surface of the wear member in movement along the pathway, wherein the replaceable wear member features a first material at the wear surface thereof, the base member features a second material of greater hardness than said first material at a surface of the base member that underlies the wear surface of the wear member, and the first material of the wear member has a greater frictional coefficient with the drill line than the second material of the base member, whereby routing of the drill line over said wear surface of the wear member imparts greater frictional resistance to the drill line than if routed directly over the underlying surface of the base member, and the harder second material at the underlying surface of the base member remains intact should the wear member become fully worn through.

2. The cable guide of claim 1 wherein the first material is polymeric material.

3. The cable guide of claim 1 wherein the first material comprises nylon.

4. The cable guide of claim 1 wherein the second material is metallic material.

5. The cable guide of claim 1 wherein the base member comprises a sheave, a peripheral groove of which defines the pathway.

6. The cable guide of claim 5 wherein the sheave is fixed against rotation about a central axis thereof around which the peripheral groove extends.

7. The cable guide of claim 5 wherein the sheave is rotatable about a central axis thereof around which the peripheral groove extends.

8. The cable guide of claim 7 comprises a brake operable to limit a rotational speed of the sheave about the central axis thereof.

9. The cable guide of claim 5 wherein the sheave is carried in the overhead position by a tugger line of the drilling rig.

10. The cable guide of claim 1 wherein the pathway is defined by an upward facing groove curving over an underlying portion of the base member.

11. The cable guide of claim 10 wherein the replaceable wear member comprises a curved liner for receipt in the upward facing groove, the curved liner having a curvature that spans less than 360-degrees.

12. The cable guide of claim 1 wherein the wear member comprises a hollow sleeve sized for passage of the drill line through said sleeve.

13. The cable guide of claim 12 wherein the hollow sleeve is flanged at opposing ends thereof, and the base member comprises multiple pieces fastenable together from different sides of the hollow sleeve for clamping of the sleeve in place between said multiple pieces.

14. The cable guide of claim 1 wherein the base member is slidably carried for displacement back and forth along a direction transverse to the pathway.

15. The cable guide of claim 14 wherein the base member is movable between a deployed position aligned with the draw works and a stored position withdrawn from alignment with the draw works.

16. The cable guide of any one of claim 1 wherein the base member is carried by a support arm mounted atop a housing of the draw-works.

17. The cable guide of claim 16 wherein the support arm is movably mounted to the housing of the draw-works.

18. The cable guide of claim 16 wherein the support arm is adjustable in length.

19. The cable guide of claim 16 wherein the support arm comprises hinged arm sections pivotal relative to one another to adjust an angle therebetween for adjustment the position of the cable guide by varying said angle.

* * * * *